US006986601B2

(12) United States Patent
Sadler et al.

(10) Patent No.: US 6,986,601 B2
(45) Date of Patent: Jan. 17, 2006

(54) PIEZOELECTRIC MIXING METHOD

(75) Inventors: Daniel J. Sadler, Gilbert, AZ (US); Rajnish G. Changrani, Champaign, IL (US); Chia Fu Chou, Chandler, AZ (US); Frederic Zenhausern, Fountain Hills, AZ (US)

(73) Assignee: Motorola, Inc., Schaumburg, IL (US)

( * ) Notice: Subject to any disclaimer, the term of this patent is extended or adjusted under 35 U.S.C. 154(b) by 205 days.

(21) Appl. No.: 10/437,515

(22) Filed: May 13, 2003

(65) Prior Publication Data

US 2004/0228205 A1 Nov. 18, 2004

(51) Int. Cl.
*B01F 11/02* (2006.01)

(52) U.S. Cl. ..... 366/116; 366/127

(58) Field of Classification Search ..... 366/116, 366/127; 422/224
See application file for complete search history.

(56) References Cited

U.S. PATENT DOCUMENTS 2,447,061 A * 8/1948 Franklin ..... 310/369
2,592,703 A * 4/1952 Jaffe ..... 310/328
3,117,768 A * 1/1964 Carlin ..... 366/114
3,198,489 A * 8/1965 Finch ..... 366/113
4,433,916 A * 2/1984 Hall ..... 366/114
4,705,980 A * 11/1987 Mishiro ..... 310/323.19
5,414,322 A * 5/1995 Kosinski et al. ..... 310/366
2004/0032793 A1 * 2/2004 Falcon ..... 366/341

* cited by examiner

*Primary Examiner*—David Sorkin

(57) ABSTRACT

A method for mixing at least two fluids includes introducing the at least two fluids into a mixing chamber. The mixing chamber includes a piezoelectric component (500) for mechanical actuation of fluid motion within or adjacent the mixing chamber. The piezoelectric component includes at least first (400), second (410), third (420), and fourth (430) actuation domains, the first and third actuation domains being on first and third opposed sides of the piezoelectric component, and the second and fourth actuation domains being on second and fourth opposed sides of the piezoelectric component. The first and third domains are actuated at a first phase of a frequency of oscillation, and the second and fourth domains are actuated at a second phase of the frequency of oscillation.

4 Claims, 1 Drawing Sheet

-PRIOR ART-

-PRIOR ART-

PIEZOELECTRIC MIXING METHOD

FIELD OF INVENTION

The present invention generally concerns systems and methods for uniformly mixing fluid phases wherein the mechanical actuation frequencies, local flow velocities and/or device dimensions generally correspond to Reynolds numbers typically less than about unity; and more particularly, in various representative and exemplary embodiments, to a micro-scale device for mixing at least two liquid, viscous or gaseous.

BACKGROUND

The mixing of fluids is frequently desired in order to perform chemical reactions. Representatively, a controlled and homogeneous mixing of reagents is generally desirable. In certain applications or operating environments, the combined volume required for the mixture may need to be kept as small as possible so that the consumption of reagents does not become excessive.

A common conventional means of mixing two or more miscible liquids is to stir, either mechanically with a utensil or by exploiting certain fluidic forces, to produce localized regions corresponding to relatively high fluid flow rates that generally operate to produce localized turbulent forces within the fluid field. This turbulence generally provides a relatively large contact surface between the liquids such that diffusion of the fluid components into each other produces a substantially homogeneous mixture. When the flow velocity of a fluid is relatively small, the corresponding Reynolds number R may take on values less than unity as in $$R = \frac{Ud}{v} < 1,$$

where U is the mean flow velocity, d the diameter of the flow channel, and v the kinematic viscosity. Low Reynolds number environments may be encountered, for example, in capillary systems, systems where the device scales are relatively small and/or fluid flow velocities are relatively small, or systems where viscous forces largely dominate the inertial forces produced. In such cases as these, the inertial forces that produce turbulence and the resulting relatively large contact areas generally required to promote mixing typically cannot be achieved. Accordingly, fluid mixing in these types of systems is generally regarded as a diffusion limited process usually requiring the fluid components to remain in relative contact with each other for prolonged periods of time in order to achieve any substantial mixing. For many applications where two or more fluid components are to be mixed and/or dispensed rapidly in the regimen of low Reynolds numbers, this may be unacceptable. Moreover, while pre-mixing of fluid components in certain liquid phase applications may offer an alternative option, pre-mixing of gas phase reaction components is generally not possible. Accordingly, what may be desired is a system and method for the rapid production of substantially homogeneous fluid mixtures in low Reynolds number regimes.

SUMMARY OF THE INVENTION

A method for mixing at least two fluids includes introducing the at least two fluids into a mixing chamber. The mixing chamber includes a piezoelectric component for mechanical actuation of fluid motion within or adjacent the mixing chamber. The piezoelectric component includes at least first, second, third, and fourth actuation domains, the first and third actuation domains being on first and third opposed sides of the piezoelectric component, and the second and fourth actuation domains being on second and fourth opposed sides of the piezoelectric component. The first and third domains re actuated at a first phase of a frequency of oscillation, and the second and fourth domains are actuated at a second phase of the frequency of oscillation.

BRIEF DESCRIPTION OF THE DRAWINGS

Representative elements, operational features, applications and/or advantages of the present invention reside inter alia in the details of construction and operation as more fully hereafter depicted, described and claimed—reference being made to the accompanying drawings forming a part hereof, wherein like numerals refer to like parts throughout. Other elements, operational features, applications and/or advantages will become apparent to skilled artisans in light of certain exemplary embodiments recited in the Detailed Description, wherein:

Figure 1:
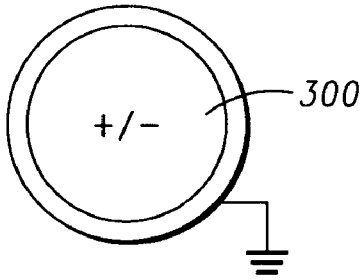
FIG. 1 representatively depicts a piezoelectric disk in accordance with one exemplary embodiment of the present invention.

Those skilled in the art will appreciate that elements in the Figures are illustrated for simplicity and clarity and have not necessarily been drawn to scale. For example, the dimensions of some of the elements in the Figures may be exaggerated relative to other elements to help improve understanding of various embodiments of the present invention. Furthermore, the terms 'first', 'second', and the like herein, if any, are used inter alia for distinguishing between similar elements and not necessarily for describing a sequential or chronological order. Moreover, the terms 'front', 'back', 'top', 'bottom', 'over', 'under', and the like in the Description and/or in the claims, if any, are generally employed for descriptive purposes and not necessarily for comprehensively describing exclusive relative position. Skilled artisans will therefore understand that any of the preceding terms so used may be interchanged under appropriate circumstances such that various embodiments of the invention described herein, for example, are capable of operation in other orientations than those explicitly illustrated or otherwise described.

DETAILED DESCRIPTION OF EXEMPLARY EMBODIMENTS

The following descriptions are of exemplary embodiments of the invention and the inventors' conceptions of the best mode and are not intended to limit the scope, applicability or configuration of the invention in any way. Rather, the following Description is intended to provide convenient illustrations for implementing various embodiments of the invention. As will become apparent, changes may be made in the function and/or arrangement of any of the elements described in the disclosed exemplary embodiments without departing from the spirit and scope of the invention.

A detailed description of an exemplary application, namely a system and method for mixing at least two liquid, viscous or gaseous phases, is provided as a specific enabling disclosure that may be readily generalized by skilled artisans to any application of the disclosed system and method for uniformly mixing fluid phases where the operational frequencies, flow velocities and/or device dimensions generally correspond to Reynolds numbers less than about unity in accordance with various embodiments of the present invention.

Chemical reactions between different species generally rely upon intimate contact between reacting species. Premixing reactant streams in microfluidic channels for microreactor applications, for example, has been extremely difficult inasmuch as mixing at the micro-scale is primarily governed by diffusion. As a result of difficulties related to pre-mixing reactant streams before they enter, for example, a microreactor, the reactants are usually pre-mixed prior to being supplied into the microfluidic system. However, external pre-mixing, while generally possible in some liquid phase applications, is usually not possible in most gas-phase applications.

Furthermore, the electronic detection of DNA generally requires that single stranded DNA contained in solution be capable of attaching to corresponding complimentary DNA which may be pre-synthesized, for example, on a detection chip. Without active mixing, diffusion is generally the dominant process by which such single stranded molecules in solution may be capable of "finding" and attaching to their complimentary DNA for subsequent detection. If the solution chamber is relatively large, achieving a detectable signal may take up to two hours, depending on the target concentration. Active mixing or stirring of the solution may greatly reduce hybridization times by allowing the fluid particles to traverse the detection region of the chamber much more quickly than by means of diffusion alone. Conventional piezoelectric mixing, however, has been adapted for an optimum operational frequency of about 5 kHz. Being in the audible frequency range, this often produces noise which may be generally unacceptable for a commercial product. Accordingly, in one representative application in accordance with various embodiments of the present invention, methods for improved piezoelectric mixing efficiency with the elimination or otherwise reduced production of audible noise may be desirable.

In an exemplary embodiment, in accordance with a representative aspect of the present invention, a piezoelectric disk may be divided into a plurality of actuation domains. For example, actuation quadrants as generally depicted, for example, in FIG. 2, may be provided. Unlike the substantially unitary piezo disk, as generally depicted for example in FIG. 1, the actuation quadrant structure of FIG. 2 may be effectively operated above the audible frequency range. Moreover, the mixing efficiency is also improved.

Figure 2:
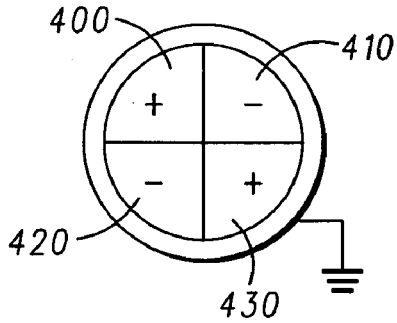
FIG. 2 representatively depicts a piezoelectric disk in accordance with another exemplary embodiment of the present invention.
Figure 3:
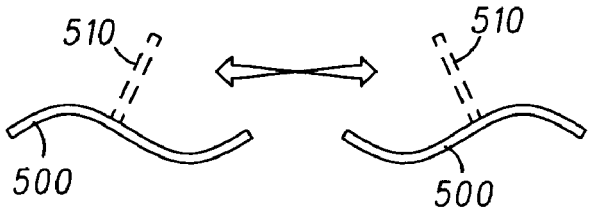
FIG. 3 representatively depicts an actuation mode of a piezoelectric component in accordance with one exemplary embodiment of the present invention.
Figure 4:
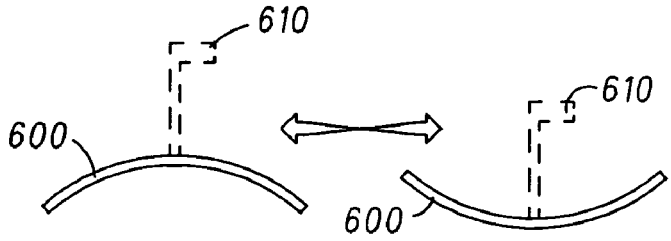
FIG. 4 representatively depicts an actuation mode of a piezoelectric component in accordance with another exemplary embodiment of the present invention.

Deformation of the piezoelectric disk 300 of FIG. 1 is generally depicted in FIG. 4. As the piezoelectric disk 600 is actuated 300, the general displacement corresponds to motion along the axis normal to the disk 600. For convenience of illustration, a graphical artifact 610 is provided to demonstrate relative vertical displacement normal to the surface of disk 600 during actuation 300. However, actuated displacement using the quadrant structure of FIG. 2 not only produces vertical displacement normal to any quadrant element, but also produces motion in the plane of the piezoelectric disk 500, as generally depicted, for example, in FIG. 3. For further convenience of illustration, a graphical artifact 510 is provided to demonstrate relative "wagging" displacement within the plane of piezoelectric disk 500 during actuation 400, 410, 420, 430.

Additionally, by running diagonal quadrants in phase with each other 400, 430 and 180 degrees out of phase with the opposite diagonal 410, 420, higher order mechanical modes may be exploited for faster, more efficient mixing. In a representative application of one exemplary embodiment of the present invention, colored die was used to confirm the ability of the opposed quadrant actuation to substantially increase the rate of mixing over diffusion alone and over that of a single piezoelectric disk mode as generally depicted, for example, in FIG. 4.

Although various representative embodiment of the present invention generally utilize moving parts, the operation frequency may be suitably adapted to be sufficiently high in order to eliminate audible noise. Moreover, hybridization times may be significantly reduced with relatively minimal increase in device size and/or complexity.

In other representative and exemplary applications, various embodiments of the present invention may be employed, for example, to mix methanol and water in a reformed hydrogen fuel cell and/or a direct methanol fuel cell. Additionally, various embodiments of the present invention have demonstrated the capability to mix a variety of fluids including, for example: gases; liquids: gas-liquid mixtures; etc. Other representative applications may include the mixing of fuels supplying a micro-reactor and/or micro-combustion chamber.

Skilled artisans will appreciate that the geometries depicted in the figures are provide for representative and convenient illustration and that many other geometries may be alternatively, conjunctively and/or sequentially employed to produce substantially the same result.

In the foregoing specification, the invention has been described with reference to specific exemplary embodiments; however, it will be appreciated that various modifications and changes may be made without departing from the scope of the present invention as set forth in the claims below. The specification and figures are to be regarded in an illustrative manner, rather than a restrictive one and all such modifications are intended to be included within the scope of the present invention. Accordingly, the scope of the invention should be determined by the claims appended hereto and their legal equivalents rather than by merely the examples described above. For example, the steps recited in any method or process claims may be executed in any order and are not limited to the specific order presented in the claims. Additionally, the components and/or elements recited in any apparatus claims may be assembled or otherwise operationally configured in a variety of permutations to produce substantially the same result as the present invention and are accordingly not limited to the specific configuration recited in the claims.

Benefits, other advantages and solutions to problems have been described above with regard to particular embodiments; however, any benefit, advantage, solution to problems or any element that may cause any particular benefit, advantage or solution to occur or to become more pronounced are not to be construed as critical, required or essential features or components of any or all the claims.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted by those skilled in the art to specific environments, manufacturing specifications, design parameters or other operating requirements without departing from the general principles of the same.

We claim:

1. A method for mixing at least two fluids, said method comprising:

introducing the at least two fluids into a mixing chamber, said mixing chamber comprising a piezoelectric component for mechanical actuation of fluid motion within said mixing chamber, said piezoelectric component comprising at least first, second, third, and fourth actuation domains, the first and third actuation domains being on first and third opposed sides of the piezoelectric component, and the second and fourth actuation domains being on second and fourth opposed sides of the piezoelectric component;

actuating the first and third domains at a first phase of a frequency of oscillation thereby causing the first and third sides to oscillate in unison and alternatively in first and second opposed directions;

actuating the second and fourth domains at a second phase of the frequency of oscillation thereby causing the second and fourth sides to oscillate in the first direction when the first and third sides oscillate in the second direction, and in the second direction when the first and third sides oscillate in the first direction.

2. The method of claim 1, wherein said frequency is in the range of about 5 kHz to about 25 kHz.

3. The method of claim 1, wherein a difference between the first and second phases corresponds to about 180 degrees.

4. The method of claim 1, wherein said plurality of actuation domains comprises four quadrants of a piezoelectric disk.

* * * * *